US009754737B2

(12) United States Patent
Yang et al.

(10) Patent No.: US 9,754,737 B2
(45) Date of Patent: Sep. 5, 2017

(54) ELECTRICAL SWITCHING APPARATUS AND STORED ENERGY ASSEMBLY THEREFOR

(71) Applicant: EATON CORPORATION, Cleveland, OH (US)

(72) Inventors: He Yang, Shanghai (CN); Li Yu, Shanghai (CN); Wenjie Hou, Shanghai (CN); Mark Mao, Shanghai (CN); Bingyu Zhou, Zhejiang Province (CN)

(73) Assignee: EATON CORPORATION, Cleveland, OH (US)

( * ) Notice: Subject to any disclaimer, the term of this patent is extended or adjusted under 35 U.S.C. 154(b) by 221 days.

(21) Appl. No.: 14/719,365

(22) Filed: May 22, 2015

(65) Prior Publication Data

US 2016/0343520 A1 Nov. 24, 2016

(51) Int. Cl.
*H01H 5/00* (2006.01)
*H01H 3/30* (2006.01)
(Continued)

(52) U.S. Cl.
CPC ..... *H01H 3/3015* (2013.01); *H01H 3/3031* (2013.01); *H01H 3/3042* (2013.01);
(Continued)

(58) Field of Classification Search
CPC .. H01H 3/00; H01H 3/02; H01H 3/06; H01H 3/22; H01H 3/32; H01H 3/34; H01H 3/38;
(Continued)

(56) References Cited

U.S. PATENT DOCUMENTS 3,365,956 A * 1/1968 Koch ..... H01H 3/34 192/12 BA
5,274,206 A * 12/1993 Milianowicz ..... H01H 3/3021 200/305
(Continued)

FOREIGN PATENT DOCUMENTS

DE 616 728 C 8/1935
DE 16 90 038 A1 4/1971

OTHER PUBLICATIONS

European Patent Office, "International Search Report and Written Opinion", PCT/US2016/031725, Aug. 2, 2016, 10 pp.

*Primary Examiner* — Anthony R. Jimenez
(74) *Attorney, Agent, or Firm* — Eckert Seamans; John Powers; Grant Coffield

(57) ABSTRACT

A stored energy assembly is for an electrical switching apparatus. The electrical switching apparatus includes a housing and a mount coupled to the housing. The stored energy assembly includes: a ratchet assembly having: a first ratchet member, a second ratchet member, and a shaft extending through the first ratchet member and the second ratchet member, the shaft being structured to extend through the mount; a stored energy mechanism coupled to the shaft; at least one charging mechanism structured to charge the stored energy mechanism in order to store energy; and a clutch assembly including a link assembly cooperating with the first ratchet member and the second ratchet member in order to transmit energy from the charging mechanism to the stored energy mechanism.

18 Claims, 7 Drawing Sheets

(51) Int. Cl.
*H01H 3/34* (2006.01)
*H01H 3/46* (2006.01)
*H01H 3/58* (2006.01)

(52) U.S. Cl.
CPC ..... *H01H 3/34* (2013.01); *H01H 3/46* (2013.01); *H01H 3/58* (2013.01); *H01H 3/3021* (2013.01); *H01H 2003/3089* (2013.01); *H01H 2235/028* (2013.01)

(58) Field of Classification Search
CPC .. H01H 3/40; H01H 3/42; H01H 3/54; H01H 3/56; H01H 3/3015; H01H 3/3031; H01H 3/30; H01H 3/3042; H01H 3/46; H01H 3/58; H01H 3/3021; H01H 2003/02; H01H 2003/22; H01H 2003/30; H01H 2003/32; H01H 2003/40; H01H 2003/3089; H01H 2235/028; H01H 19/00; H01H 19/18; H01H 19/28
USPC ... 200/400, 19.03, 19.18, 19.19, 19.2–19.22, 200/238
See application file for complete search history.

(56) References Cited

U.S. PATENT DOCUMENTS

| | | | | |
|---|---|---|---|---|
| 5,938,008 | A | 8/1999 | Wehrli, III et al. | |
| 6,160,234 | A * | 12/2000 | Wehrli, III ..... | H01H 3/3021 200/400 |
| 6,486,758 | B1 | 11/2002 | Olszewski et al. | |
| 7,598,468 | B2 | 10/2009 | Chen et al. | |
| 7,696,447 | B2 | 4/2010 | Chen et al. | |

* cited by examiner

ELECTRICAL SWITCHING APPARATUS AND STORED ENERGY ASSEMBLY THEREFOR

BACKGROUND

Field

The disclosed concept pertains generally to electrical switching apparatus, such as, for example, circuit breakers. The disclosed concept also pertains to stored energy assemblies for circuit breakers.

Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Some medium voltage circuit breakers, for example, employ a spring-operated stored energy assembly. Specifically, the operating mechanism of such circuit breakers typically includes an opening assembly having at least one spring which facilitates the opening (e.g., separation) of the electrical contact assemblies, a closing assembly including a number of springs that close the electrical contact assemblies, and a charging mechanism for charging the spring(s). The contact assemblies are closed by releasing the stored energy of the closing assembly spring(s). The closing assembly spring(s) is/are charged either manually, using a manual charging mechanism such as, for example, a charging handle, or automatically using, for example, a motor-driven charging mechanism or other suitable electromechanical charging mechanism. Each of the manual and automatic charging mechanisms of known stored energy assemblies requires its own individual "chain" or assembly of components, in order to link the corresponding power source (e.g., human power; motor power) to the spring(s) that must be charged.

Typically, there are clutch units between the charging mechanisms and the spring(s) that regulate the power being transmitted to the springs. It is known to employ compression springs as the springs that regulate the power to be transmitted. However, employing compression springs often results in an unbalanced force on the transmission shaft, and a significantly increased volume of space being taken up. It is also known to employ clock springs as the springs that regulate power. However, known clutch units for stored energy assemblies employing clock springs often have a significant number of parts and as a result, are relatively difficult to assemble/manufacture. Furthermore, such clutch units are also not compact.

There is thus room for improvement in electrical switching apparatus and in stored energy assemblies therefor.

SUMMARY

These needs and others are met by embodiments of the disclosed concept, which are directed to an electrical switching apparatus and stored energy assembly therefor which employs a more efficient clutch assembly that transmits energy from a number of charging mechanisms to a stored energy mechanism.

In accordance with one aspect of the disclosed concept, a stored energy assembly for an electrical switching apparatus is provided. The electrical switching apparatus includes a housing and a mount coupled to the housing, the stored energy assembly comprises: a ratchet assembly comprising: a first ratchet member, a second ratchet member, and a shaft extending through the first ratchet member and the second ratchet member, the shaft being structured to extend through the mount; a stored energy mechanism coupled to the shaft; at least one charging mechanism structured to charge the stored energy mechanism in order to store energy; and a clutch assembly comprising a link assembly cooperating with the first ratchet member and the second ratchet member in order to transmit energy from the at least one charging mechanism to the stored energy mechanism.

In accordance with another aspect of the disclosed concept, an electrical switching apparatus comprises: a housing; a mount coupled to the housing; and a stored energy assembly comprising: a ratchet assembly comprising: a first ratchet member, a second ratchet member, and a shaft extending through the first ratchet member, the second ratchet member, and the mount, a stored energy mechanism coupled to the shaft, at least one charging mechanism structured to charge the stored energy mechanism in order to store energy, and a clutch assembly comprising a link assembly cooperating with the first ratchet member and the second ratchet member in order to transmit energy from the at least one charging mechanism to the stored energy mechanism.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
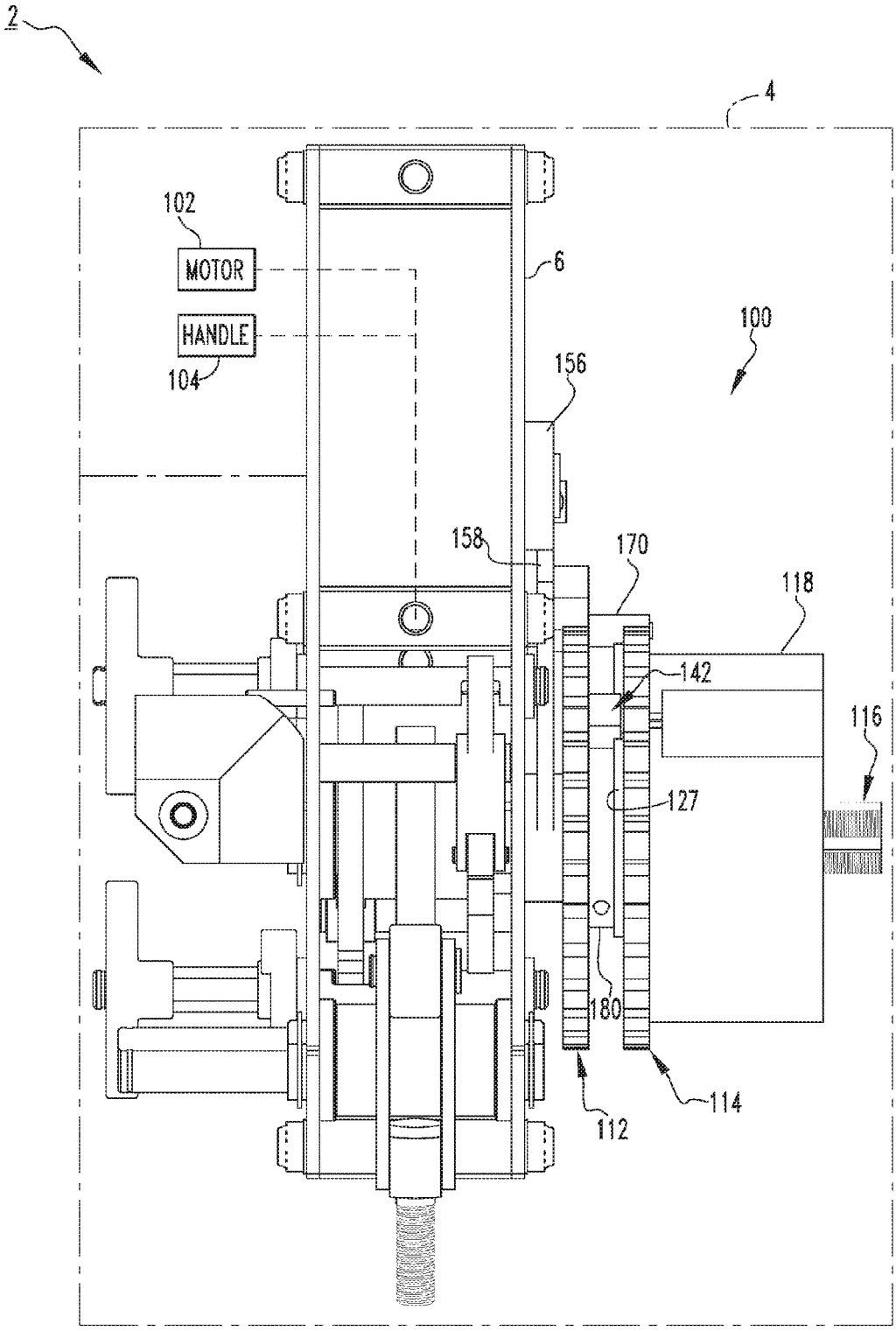
FIG. 1 is a plan view of an electrical switching apparatus and stored energy assembly therefor, in accordance with an embodiment of the disclosed concept, with the electrical switching apparatus housing being shown in simplified form in phantom line drawing.

For purposes of the description hereinafter, directional phrases used herein such as, for example, "clockwise,"

"counterclockwise," "up," "down," and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

FIG. 1 shows a simplified view of an electrical switching apparatus, such as a circuit breaker 2, employing a stored energy assembly 100 in accordance with the disclosed concept. The circuit breaker 2 includes a housing 4 and a mount 6 coupled to the housing 4. The stored energy assembly 100 includes a number of charging mechanisms such as a motor 102 (shown in simplified form) and a manual charging mechanism (see, for example, handle 104, shown in simplified form). The charging mechanisms 102, 104 charge a stored energy mechanism (see, for example, clock spring 106, shown in FIG. 3) in order to store energy. When the clock spring 106 (FIG. 3) is fully charged and the stored energy therein is released, electrical contact assemblies (not shown) of the circuit breaker 2 can be opened or closed.

Figure 2:
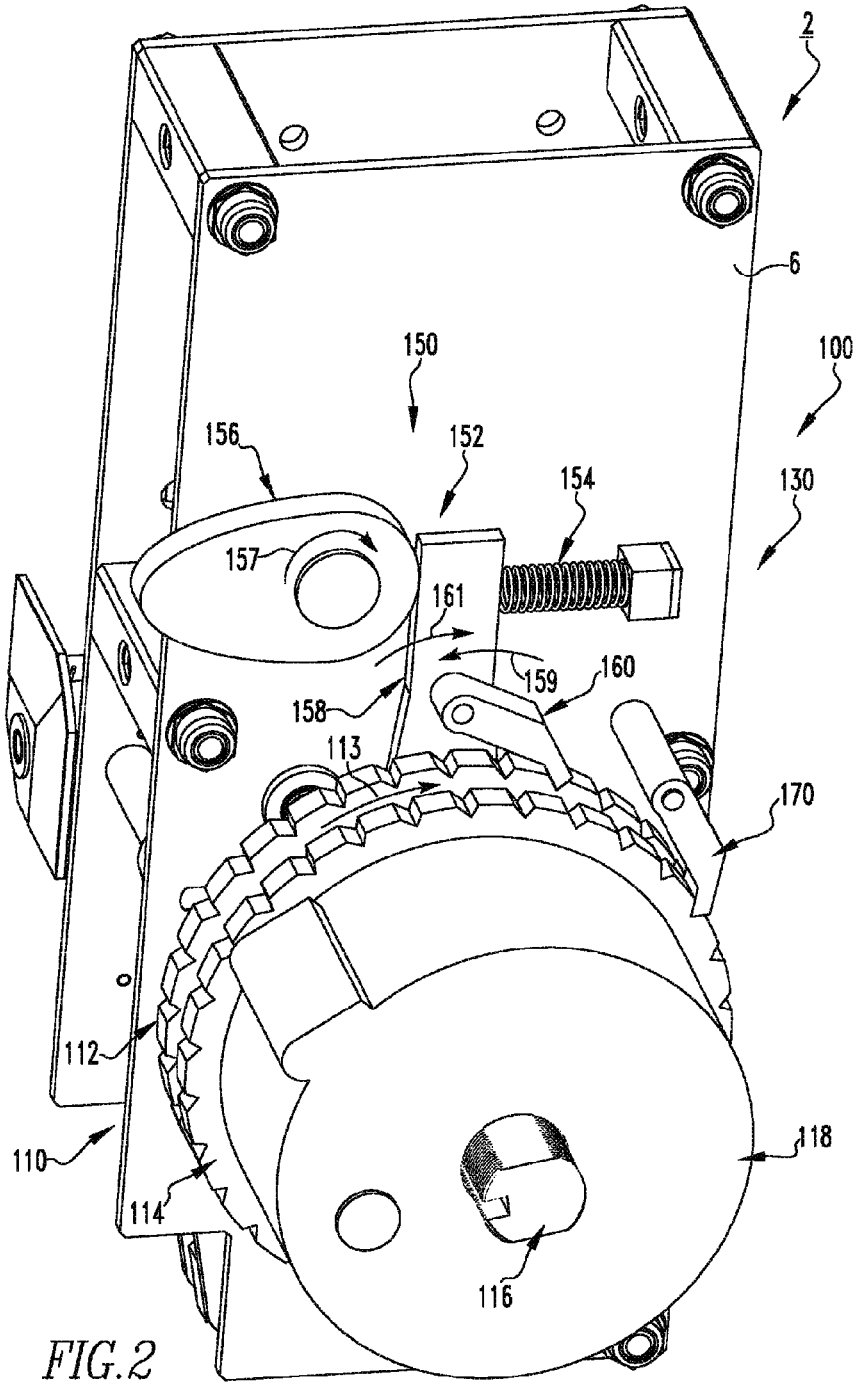
FIG. 2 is a front isometric view of a portion of the electrical switching apparatus and stored energy assembly therefor of FIG. 1.
Figure 3:
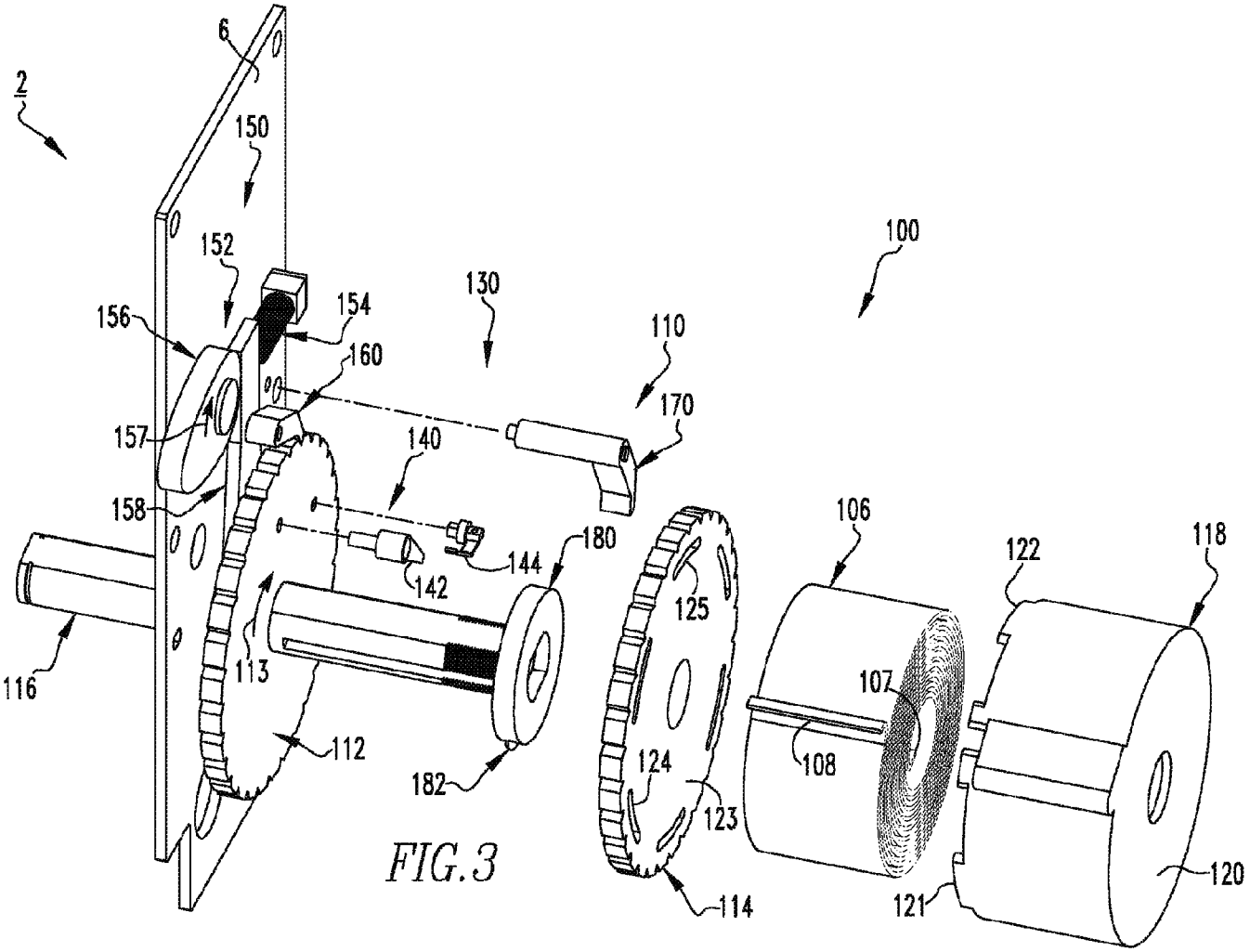
FIG. 3 is an exploded isometric view of a portion of the electrical switching apparatus and stored energy assembly therefor of FIG. 1.

Referring to FIGS. 2 and 3, the stored energy assembly 100 further includes a ratchet assembly 110 and a clutch assembly 130 that together operate to transmit energy from the charging mechanisms 102,104 (FIG. 1) to the clock spring 106 (FIG. 3) in an efficient manner that employs less components than prior art stored energy assemblies (not shown). As a result, assembly and/or manufacturing of the circuit breaker 2 is advantageously simplified, and cost is reduced. The ratchet assembly 110 includes a first ratchet member 112, a second ratchet member 114, a shaft 116, and a coupling member (see, for example, spring box 118). The shaft 116 extends through the mount 6, the clock spring 106, the first ratchet member 112, the second ratchet member 114, and the spring box 118. The second ratchet member 114 is located between the first ratchet member 112 and the clock spring 106 (FIG. 3). The clutch assembly 130 includes a link assembly 140 (FIG. 3), a transfer assembly 150, a trip wheel 180, a separator member 182, and a biasing element (e.g., without limitation, spring 184, shown in FIGS. 7-8C). The trip wheel 180 is located between the first ratchet member 112 and the second ratchet member 114. The transfer assembly 150 cooperates with the charging mechanisms 102,104 (FIG. 1) in order transmit energy therefrom into movement of the first ratchet member 112, as will be described in greater detail hereinbelow. The link assembly 140 cooperates with the first ratchet member 112 and the second ratchet member 114 in order to transmit energy from the charging mechanisms 102,104 (FIG. 1) to the clock spring 106 (FIG. 3).

Continuing to refer to FIG. 3, the spring box 118 includes a body 120 and a number of tangs (two example tangs 121,122 are indicated) extending from the body 120. The second ratchet member 114 includes a side portion 123 facing away from the first ratchet member 112. The side portion 123 has a number of slots (two example slots 124,125 are indicated). Each of the tangs 121,122 extends into a corresponding one of the slots 124,125 in order to couple the spring box 118 to the second ratchet member 114. Furthermore, the clock spring 106 is enclosed by and coupled to the spring box 118. More specifically, the clock spring 106 has an inner hook portion 107 and an outer hook portion 108. The inner hook portion 107 engages and latches onto the shaft 116 in order to be coupled thereto. The outer hook portion 108 engages and latches onto the spring box 118 in order to be coupled thereto. Additionally, because the tangs 121,122 extend into the slots 124,125, it will be appreciated that the spring box 118 is fixedly coupled to the second ratchet member 114. Thus, when the second ratchet member 114 rotates (i.e., during a charging operation) with respect to the shaft 116, the second ratchet member 114 causes the spring box 118 to rotate at the same rotational velocity with respect to the shaft 116 in order to transmit energy from the charging mechanisms 102,104 (FIG. 1) to the clock spring 106 (FIG. 3). More specifically, because the outer hook portion 108 is latched onto the spring box 118, when the spring box 118 rotates (i.e., responsive to rotation of the second ratchet member 114), the outer hook portion 108 of the clock spring 106 rotates at the same rotational velocity as the spring box 118 and thus the second ratchet member 114. In this manner, the movement of the second ratchet member 114, which is caused by the charging mechanisms 102,104 (FIG. 1), is advantageously able to charge the clock spring 106.

Figure 4:
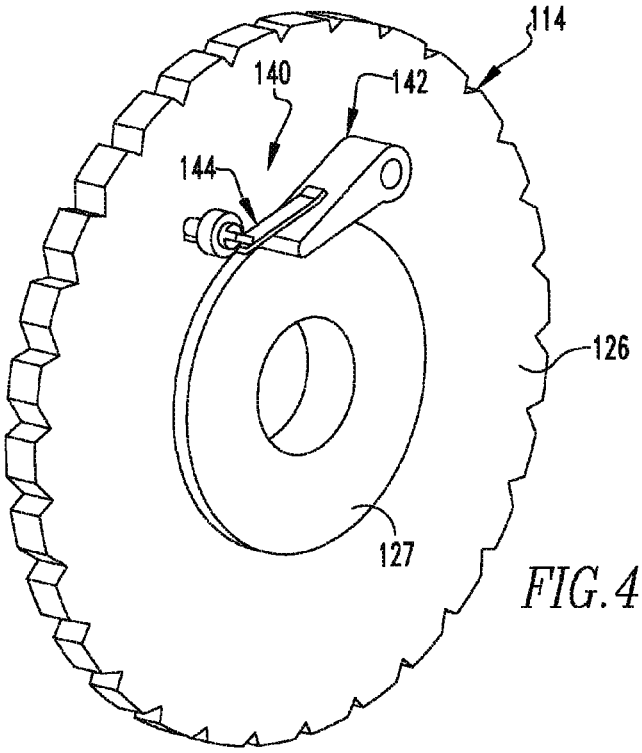
FIGS. 4 and 5 are isometric and elevation views, respectively, of a ratchet member and link assembly for the electrical switching apparatus and stored energy assembly therefor of FIG. 1.
Figure 5:
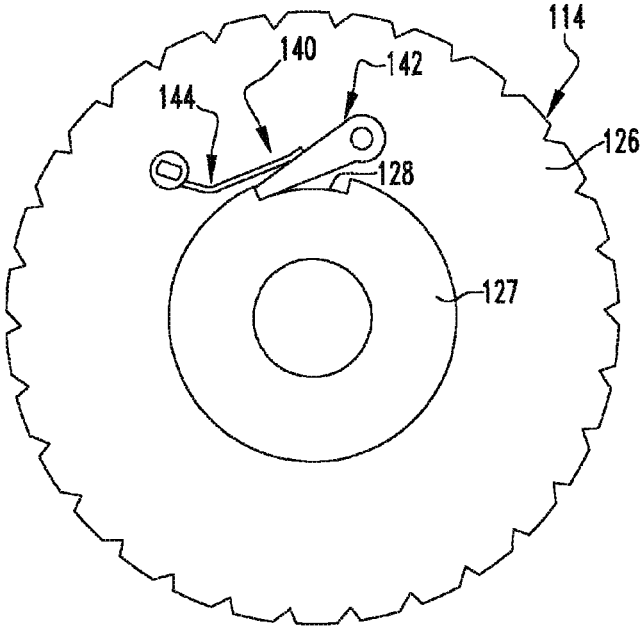

Referring to FIGS. 4 and 5, the link assembly 140, and particularly the interaction with the second ratchet member 114, will now be described in greater detail. As shown, the link assembly 140 includes a linking member 142 and a biasing element (e.g., without limitation, blade spring 144). The linking member 142 and the blade spring 144 are each coupled to the first ratchet member 112 (FIGS. 1-3). As shown in FIGS. 4 and 5, the second ratchet member 114 includes a disc-shaped body 126 and a protrusion 127. It will be appreciated that the protrusion 127 extends from the body 126 toward the first ratchet member 112 (FIGS. 1-3). Additionally, the protrusion 127 has a grooved region 128 (shown in FIG. 5). The blade spring 144 biases the linking member 142 toward engagement with the second ratchet member 114. When the charging mechanisms 102,104 (FIG. 1) charge the clock spring 106, the linking member 142 is biased into engagement with the grooved region 128. The engagement between the linking member 142 and the grooved region 128 advantageously allows the first ratchet member 112 (FIGS. 1-3) to drive the second ratchet member 114 in order to charge the clock spring 106, as will be discussed in greater detail below.

Referring again to FIGS. 2 and 3, the transfer assembly 150 includes a drive assembly 152 and a biasing element (e.g., without limitation, spring 154) each coupled to the mount 6. The drive assembly 152 includes a number of driving components (see, for example, cam 156, handle 158, and pawl 160). The spring 154 biases the handle 158 in a direction 159 (FIG. 2). The cam 156, the handle 158, and the pawl 160 cooperate with one another in order to transmit energy from the charging mechanisms 102,104 (FIG. 1) into movement of the first ratchet member 112. More precisely, the charging mechanisms 102,104 (FIG. 1) are structured to drive (i.e., cause to rotate) the cam 156 in a direction 157 with respect to the mount 6. In the depicted orientation of FIGS. 2 and 3, the direction 157 of rotation of the cam 156 is clockwise. Responsive to the rotation of the cam 156, and the force exerted on the handle 158 by the spring 154, the handle 158 is structured to oscillate. Specifically, the cam 156 drives the handle 158 in a direction 161, which corresponds to the clock spring 106 (FIG. 3) charging. Once the handle 158 has rotated a predetermined distance (i.e., a distance determined by the geometry of the cam 156) in the direction 161, the spring 154 forces the handle 158 in the direction 159 in order to allow the drive assembly 152 to reset.

When the handle 158 is rotating in the direction 161, the first ratchet member 112 is rotating in a direction 113 opposite the direction 159. When the first ratchet member 112 rotates in the direction 113, the clock spring 106 (FIG. 3) is being charged by the charging mechanisms 102,104 (FIG. 1). The movement of the first ratchet member 112 is directly caused by the pawl 160, which is coupled to the handle 158 and movably located on the first ratchet member 112. The pawl 160 is configured on the first ratchet member 112 in a manner wherein the pawl 160 is structured to drive (i.e., force and/or cause to move) the first ratchet member 112 and also slide on the first ratchet member 112. Specifically, when the handle 158 rotates in the direction 161, the pawl 160 drives the first ratchet member 112 in the direction 113. Moreover, when the handle 158 rotates in the direction 159, the pawl 160 slides on the first ratchet member 112 and rotates with the handle 158 in the direction 159. In other words, when the pawl 160 rotates in the direction 159, the pawl 160 does not cause the first ratchet member 112 to rotate.

As stated above, by employing the link assembly 140 (FIGS. 3, 4 and 5), the first ratchet member 112 is advantageously able to drive the second ratchet member 114 and thereby charge the clock spring 106. More specifically, when the first ratchet member 112 rotates in the direction 113, the linking member 142, which is coupled to the first ratchet member 112, pushes into the grooved region 128 of the second ratchet member 114, thereby causing the second ratchet member 114 to rotate in the direction 113 at the same rotational velocity as the first ratchet member 112. Although the disclosed concept has been described in association with the link assembly 140 and the grooved region 128 of the second ratchet member 114, it will be appreciated that a suitable alternative link assembly (not shown) and/or alternatively shaped ratchet member (not shown) may be employed in order to perform the desired function of transmitting energy from the first ratchet member 112 to the clock spring 106 (FIG. 3) without departing from the scope of the disclosed concept.

Because the second ratchet member 114 is coupled to the clock spring 106 (FIG. 3) (i.e., via the spring box 118), there is a moment exerted on the second ratchet member 114 by the clock spring 106 (FIG. 3) (i.e., via the spring box 118) in a direction 115 (see, for example, FIGS. 6A-6C) opposite the direction 113. In order to ensure that the backward moment does not prevent the clock spring 106 (FIG. 3) from being charged, the clutch assembly 130 advantageously includes another pawl 170 that is coupled to the mount 6 and movably located on the second ratchet member 114.

The functionality of the pawl 170 will now be described in greater detail with reference to FIGS. 6A-6C, which show a portion of the stored energy assembly 100 in different positions. When the pawl 160 drives the first ratchet member 112 in the direction 113 (i.e., when the first ratchet member 112 moves from its position in FIG. 6A to its position in FIG. 6B), the first ratchet member 112 moves (i.e., causes to rotate) the second ratchet member 114 a first angle 117 (shown in FIG. 6B) in the direction 113, thereby charging the clock spring 106. When the handle 158 rotates in the direction 159 (i.e., responsive to the force exerted thereon by the spring 154 (FIGS. 2 and 3)), the second ratchet member 114 rotates in the direction 115 opposite the direction 113. However, because the clutch assembly 130 includes the pawl 170, the second ratchet member 114 only rotates an angle 119 in the direction 115. The angle 119 is less than the angle 117. In other words, the pawl 170 engages the second ratchet member 114 in order to ensure that the angle 117 is greater than the angle 119 and the clock spring 106 (FIG. 3) charges.

Figure 6C:
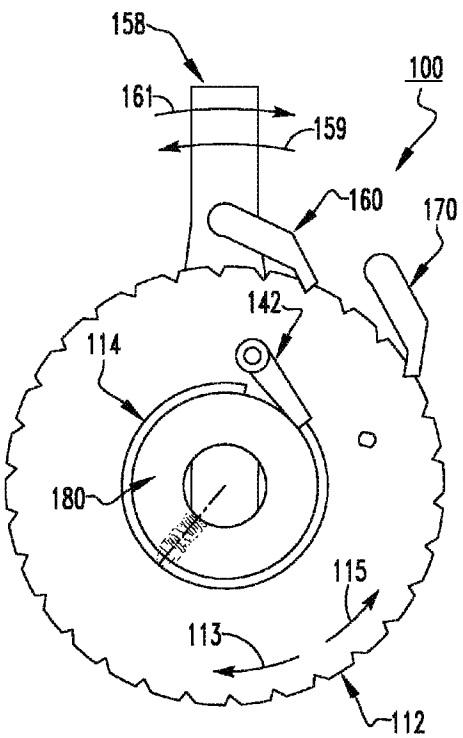
FIGS. 6A-6C show a portion of the stored energy assembly in different positions during the charging operation, with portions of the stored energy assembly removed in order to see hidden structures.
Figure 6B:
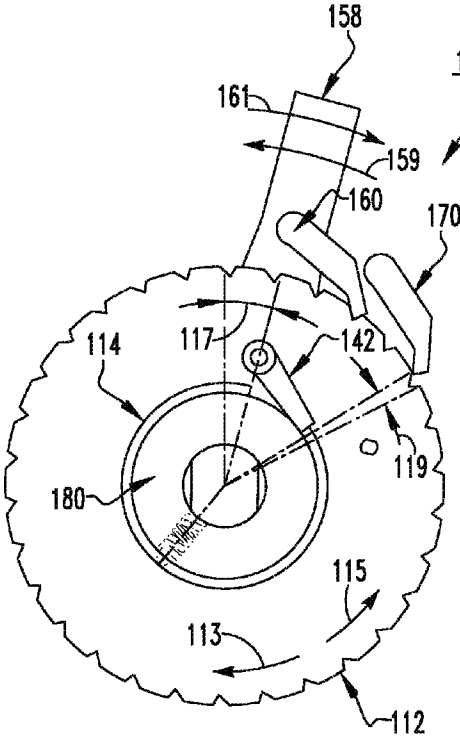
Figure 6A:
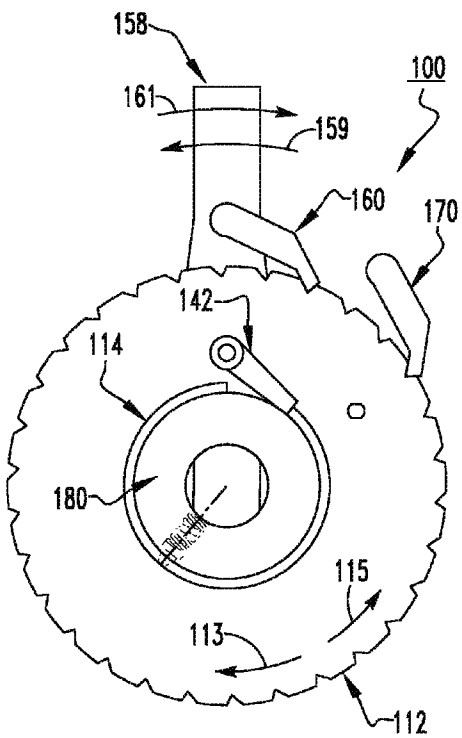

More specifically, when the second ratchet member 114 moves from the position in FIG. 6B to the position in FIG. 6C, the force exerted on the second ratchet member 114 by the pawl 170 significantly increases in order to limit the rotation in the direction 115. Stated differently, and as shown by comparing FIG. 6B to FIG. 6C, the contact area between the pawl 170 and the second ratchet member 114 (see, for example, the first ratchet member 112, which substantially overlays the second ratchet member 114) increases such that when the pawl 170 is fully engaged with the second ratchet member 114 (shown in FIG. 6C), the pawl 170 advantageously prevents further rotation in the direction 115. During this backward rotation, the second ratchet member 114 rotates the second angle 119 that is less than the first angle 117. In this manner, the clock spring 106 is advantageously able to be charged. It will be appreciated that in FIGS. 6A-6C, the outer footprint of the first ratchet member 112 and the second ratchet member 114 is substantially the same. In other words, the individual teeth of the first ratchet member 112 overlay (i.e., are located directly on top of in FIGS. 6A-6C) the individual teeth of the second ratchet member 112. However, for purposes of illustration and in order to see internal structures, a portion of the second ratchet member 114 is not shown.

Figure 7:
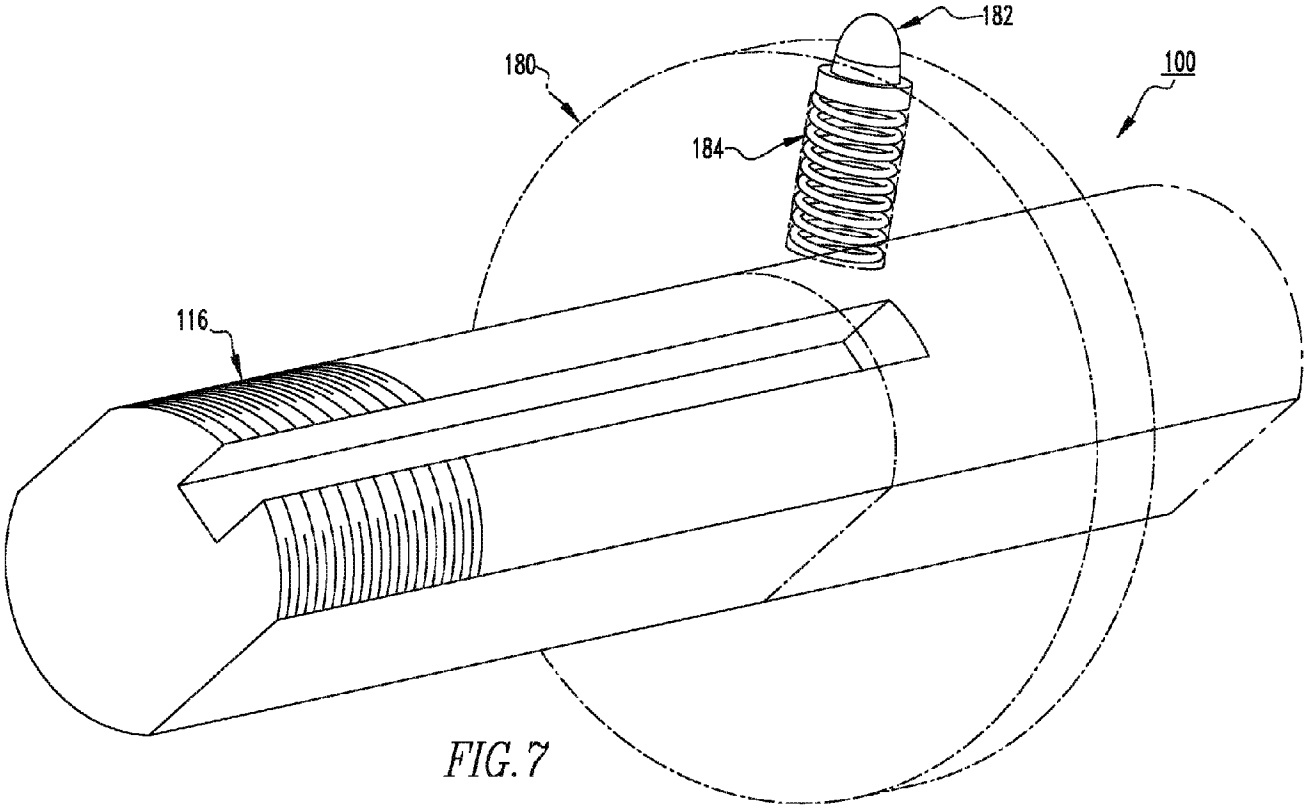
FIG. 7 is an isometric view of another portion of the stored energy assembly, shown with the trip wheel in simplified form in dashed line drawing in order to see hidden structures.
Figure 8C:
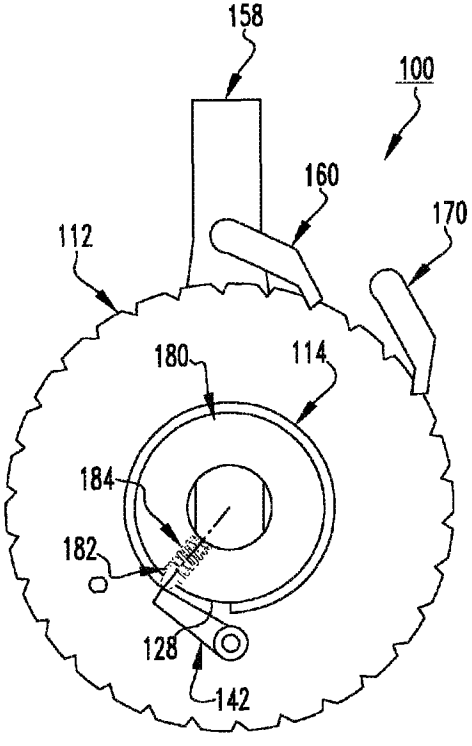
FIGS. 8A-8C show a portion of the stored energy assembly in different positions corresponding to the stored energy assembly finishing the charging operation, with portions of the stored energy assembly removed in order to see hidden structures.

Referring to FIGS. 7 through 8C, the separator member 182 and the spring 184 are structured to separate the linking member 142 from the grooved region 128 of the second ratchet member 114 in order to advantageously prevent the clock spring 106 (FIG. 3) from being overcharged. Thus, when the stored energy assembly 100 reaches the position depicted in FIG. 8C, the clock spring 106 (FIG. 3) is fully charged. As shown in FIG. 7, the spring 184 is located internal with respect to the trip wheel 180 and biases the separator member 182 away from the shaft 116. Furthermore, the separator member 182 is structured to be at least partially located internal with respect to the trip wheel 180.

Figure 8B:
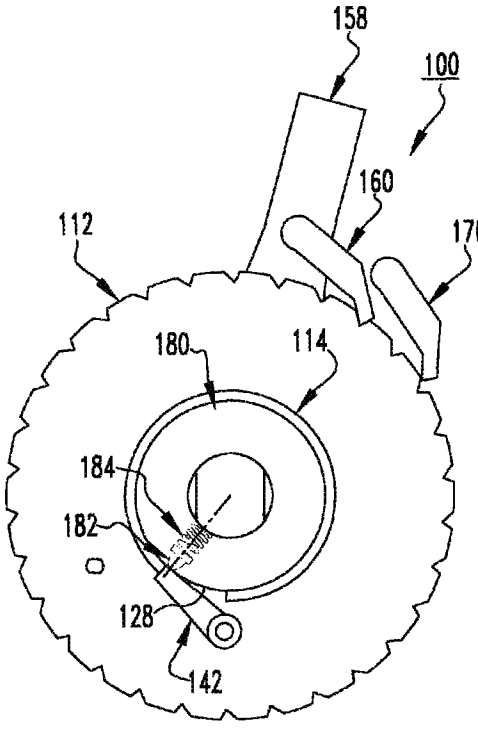
Figure 8A:
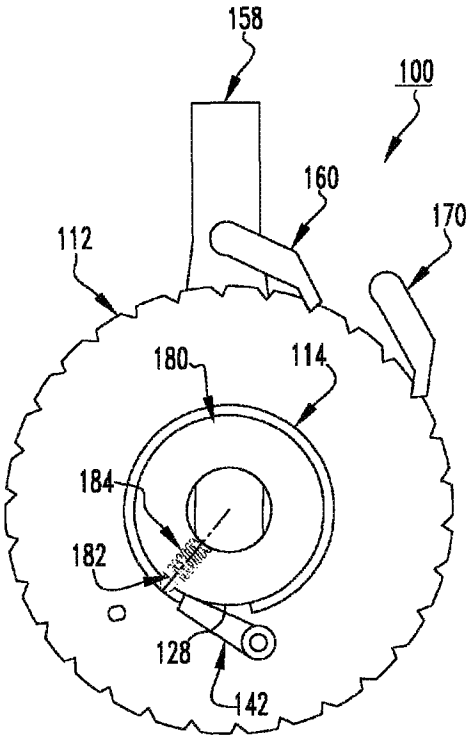

The separator member 182 is structured to move between three positions, depicted in FIGS. 8A-8C. When the separator member 182 is in the first position (FIG. 8A), the separator member 182 is spaced from the linking member 142. In this first position (FIG. 8A), the separator member 182 is partially located external with respect to the trip wheel 180. When the separator member 182 moves to the second position (FIG. 8B), the separator member 182 moves toward the shaft 116 (FIG. 7) and is driven thereto by the linking member 142. This movement of the stored energy assembly 100 from the first position (FIG. 8A) to the second position (FIG. 8B) is caused indirectly by the charging mechanisms 102,104 (FIG. 1), as discussed hereinabove. In the second position (FIG. 8B), the separator member 182 is substantially located internal with respect to the trip wheel 180. When the separator member 182 moves from the second position (FIG. 8B) to the third position (FIG. 8C), the separator member 182 drives the linking member 142 away from the grooved region 128 of the second ratchet member 114. In this third position (FIG. 8C), the separator member 182 is partially located external with respect to the trip wheel 180. Furthermore, when the separator member 182 is in the third position (FIG. 8C), the clock spring 106 (FIG. 3) is fully charged. Because the linking member 142 is spaced from the grooved region 128 when the separator member 182 is in the third position (FIG. 8C), the clock spring 106 (FIG. 3) is advantageously prevented from being overcharged by the charging mechanisms 102,104 (FIG. 1).

Accordingly, it will be appreciated that the disclosed concept provides for an improved (e.g., without limitation, easier to assemble) electrical switching apparatus 2 and stored energy assembly 100 therefor, which among other benefits, simplifies assembly and manufacturing by employing fewer components to transmit energy from a number of charging mechanisms 102,104 to a stored energy mechanism 106.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A stored energy assembly for an electrical switching apparatus, said electrical switching apparatus comprising a housing and a mount coupled to said housing, said stored energy assembly comprising:
- a ratchet assembly comprising:
  - a first ratchet member,
  - a second ratchet member, and
  - a shaft extending through said first ratchet member and said second ratchet member, said shaft being structured to extend through said mount;
- a stored energy mechanism coupled to said shaft;
- at least one charging mechanism structured to charge said stored energy mechanism in order to store energy; and
- a clutch assembly comprising a link assembly cooperating with said first ratchet member and said second ratchet member in order to transmit energy from said at least one charging mechanism to said stored energy mechanism,
- wherein said link assembly comprises a linking member and a biasing element each coupled to said first ratchet member; and wherein said biasing element biases said linking member toward engagement with said second ratchet member.

2. The stored energy assembly of claim 1 wherein said biasing element is a blade-spring.

3. The stored energy assembly of claim 1 wherein said stored energy mechanism is a clock spring.

4. The stored energy assembly of claim 1 wherein said second ratchet member comprises a disc-shaped body and a protrusion; wherein said protrusion extends from said body toward said first ratchet member; wherein said protrusion has a grooved region; and wherein, when said at least one charging mechanism charges said stored energy mechanism, said linking member engages the grooved region.

5. The stored energy assembly of claim 4 wherein said clutch assembly further comprises a trip wheel, a separator member, and another biasing element; wherein said trip wheel is disposed between said first ratchet member and said second ratchet member; wherein said shaft extends through said trip wheel; wherein said separator member is structured to be at least partially disposed internal with respect to said trip wheel; wherein said another biasing element biases said separator member away from said shaft; wherein said separator member is structured to move between a first position and a second position; wherein the first position corresponds to said separator member being substantially disposed internal with respect to said trip wheel; wherein the second position corresponds to said separator member being at least partially disposed external with respect to said trip wheel; and wherein, when said separator member moves from the first position to the second position, said separator member drives said linking member away from the grooved region.

6. The stored energy assembly of claim 1 wherein said clutch assembly further comprises a transfer assembly; wherein said transfer assembly comprises a drive assembly and a biasing element each structured to be coupled to said mount; wherein said drive assembly comprises a cam, a handle, and a pawl coupled to said handle and being movably disposed on said first ratchet member: wherein said cam, said handle, and said pawl are structured to cooperate with one another to transmit energy from said at least one charging mechanism into movement of said first ratchet member; wherein, when said at least one charging mechanism charges said stored energy mechanism, said first ratchet member rotates in a first direction; and wherein said biasing element biases said handle in a second direction opposite the first direction.

7. The stored energy assembly of claim 6 wherein said at least one charging mechanism is structured to drive said cam; wherein said cam is structured to drive said handle in order to allow said pawl to drive said first ratchet member in the first direction; and wherein said biasing element is structured to drive said handle in the second direction in order to allow said drive assembly to reset.

8. A stored energy assembly for an electrical switching apparatus, said electrical switching apparatus comprising a housing and a mount coupled to said housing, said stored energy assembly comprising:
- a ratchet assembly comprising:
  - a first ratchet member,
  - a second ratchet member, and
  - a shaft extending through said first ratchet member and said second ratchet member, said shaft being structured to extend through said mount;
- a stored energy mechanism coupled to said shaft;
- at least one charging mechanism structured to charge said stored energy mechanism in order to store energy; and
- a clutch assembly comprising a link assembly cooperating with said first ratchet member and said second ratchet member in order to transmit energy from said at least one charging mechanism to said stored energy mechanism,
- wherein said second ratchet member is disposed between said first ratchet member and said stored energy mechanism; wherein said ratchet assembly further comprises a coupling member coupled to said second ratchet member and said stored energy mechanism; and wherein said second ratchet member is structured to rotate said coupling member with respect to said shaft in order to transmit energy from said at least one charging mechanism to said stored energy mechanism.

9. The stored energy assembly of claim 8 wherein said coupling member is a spring box; wherein said spring box comprises a body and a number of tangs extending from said body; wherein said second ratchet member has a side portion facing away from said first ratchet member; wherein said side portion has a number of slots; and wherein each of said number of tangs is disposed in a corresponding one of the number of slots.

10. A stored energy assembly for an electrical switching apparatus, said electrical switching apparatus comprising a housing and a mount coupled to said housing, said stored energy assembly comprising:

a ratchet assembly comprising:

a first ratchet member, a second ratchet member, and a shaft extending through said first ratchet member and said second ratchet member, said shaft being structured to extend through said mount;

a stored energy mechanism coupled to said shaft;

at least one charging mechanism structured to charge said stored energy mechanism in order to store energy; and a clutch assembly comprising a link assembly cooperating with said first ratchet member and said second ratchet member in order to transmit energy from said at least one charging mechanism to said stored energy mechanism, wherein said clutch assembly further comprises a pawl structured to be coupled to said mount; wherein said second ratchet member is structured to rotate at a first angle in a first direction and a second angle in a second direction opposite the first direction; wherein the first direction corresponds to said stored energy mechanism charging; and wherein said pawl engages said second ratchet member in order that the first angle is greater than the second angle.

11. An electrical switching apparatus comprising:

a housing;

a mount coupled to said housing; and a stored energy assembly comprising:

a ratchet assembly comprising:

a first ratchet member, a second ratchet member, and a shaft extending through said first ratchet member, said second ratchet member, and said mount, a stored energy mechanism coupled to said shaft, at least one charging mechanism structured to charge said stored energy mechanism in order to store energy, and a clutch assembly comprising a link assembly cooperating with said first ratchet member and said second ratchet member in order to transmit energy from said at least one charging mechanism to said stored energy mechanism, wherein said link assembly comprises a linking member and a biasing element each coupled to said first ratchet member; and wherein said biasing element biases said linking member toward engagement with said second ratchet member.

12. The electrical switching apparatus of claim 11 wherein said clutch assembly further comprises a pawl coupled to said mount; wherein said second ratchet member is structured to rotate at a first angle in a first direction and a second angle in a second direction opposite the first direction; wherein the first direction corresponds to said stored energy mechanism charging; wherein said pawl engages said second ratchet member in order that the first angle is greater than the second angle; wherein said electrical switching apparatus is a medium voltage vacuum circuit breaker; wherein said stored energy mechanism is a clock spring; and wherein said at least one charging mechanism is selected from the group consisting of a motor and a manual charging mechanism.

13. The electrical switching apparatus of claim 11 wherein said second ratchet member comprises a disc-shaped body and a protrusion; wherein said protrusion extends from said body toward said first ratchet member; wherein said protrusion has a grooved region; and wherein, when said at least one charging mechanism charges said stored energy mechanism, said linking member engages the grooved region.

14. The electrical switching apparatus of claim 13 wherein said clutch assembly further comprises a trip wheel, a separator member, and another biasing element; wherein said trip wheel is disposed between said first ratchet member and said second ratchet member; wherein said shaft extends through said trip wheel; wherein said separator member is structured to be at least partially disposed internal with respect to said trip wheel; wherein said another biasing element biases said separator member away from said shaft; wherein said separator member is structured to move between a first position and a second position; wherein the first position corresponds to said separator member being substantially disposed internal with respect to said trip wheel; wherein the second position corresponds to said separator member being at least partially disposed external with respect to said trip wheel; and wherein, when said separator member moves from the first position to the second position, said separator member drives said linking member away from the grooved region.

15. The electrical switching apparatus of claim 11 wherein said second ratchet member is disposed between said first ratchet member and said stored energy mechanism; wherein said ratchet assembly further comprises a coupling member coupled to said second ratchet member and said stored energy mechanism; and wherein said second ratchet member is structured to rotate said coupling member with respect to said shaft in order to transmit energy from said at least one charging mechanism to said stored energy mechanism.

16. The electrical switching apparatus of claim 15 wherein said coupling member is a spring box; wherein said spring box comprises a body and a number of tangs extending from said body; wherein said second ratchet member has a side portion facing away from said first ratchet member; wherein said side portion has a number of slots; and wherein each of said number of tangs is disposed in a corresponding one of the number of slots.

17. The electrical switching apparatus of claim 11 wherein said clutch assembly further comprises a transfer assembly; wherein said transfer assembly comprises a drive assembly and a biasing element each coupled to said mount; wherein said drive assembly comprises a cam, a handle, and a pawl coupled to said handle and being movably disposed on said first ratchet member: wherein said cam, said handle, and said pawl are structured to cooperate with one another to transmit energy from said at least one charging mechanism into movement of said first ratchet member; wherein, when said at least one charging mechanism charges said stored energy mechanism, said first ratchet member rotates in a first direction; and wherein said biasing element biases said handle in a second direction opposite the first direction.

18. The electrical switching apparatus of claim 17 wherein said at least one charging mechanism is structured to drive said cam; wherein said cam is structured to drive said handle in order to allow said pawl to drive said first ratchet member in the first direction; and wherein said biasing element is structured to drive said handle in the second direction in order to allow said drive assembly to reset.

* * * * *